United States Patent [19]

Clark

[11] Patent Number: 4,993,907

[45] Date of Patent: Feb. 19, 1991

[54] STACKING EQUIPMENT

[75] Inventor: Alan Clark, Sutton, Great Britain

[73] Assignee: Simon Container Machinery Limited, Cheshire, United Kingdom

[21] Appl. No.: 264,522

[22] Filed: Oct. 31, 1988

[30] Foreign Application Priority Data

Nov. 7, 1987 [GB] United Kingdom ..... 8726152

[51] Int. Cl.[5] ..... B65G 57/30

[52] U.S. Cl. ..... 414/795.3; 414/789.5; 414/927; 198/374; 198/434

[58] Field of Search ..... 414/795.3, 927, 789.5, 414/795.2, 794.7; 198/434, 374, 411, 414, 456

[56] References Cited

U.S. PATENT DOCUMENTS

| | | | |
|---|---|---|---|
| 3,220,570 | 11/1965 | Swansen et al. | 414/795.3 X |
| 3,343,694 | 9/1967 | Kurki | 414/789.5 X |
| 3,352,435 | 11/1967 | Reinecke | 414/794.7 |
| 3,523,601 | 8/1970 | Roth et al. | 198/374 X |
| 3,788,497 | 1/1974 | Carlson | 414/794.7 X |
| 3,865,258 | 2/1975 | Müller | 414/794.7 X |
| 3,934,713 | 1/1976 | Van der Meer et al. | 414/794.7 X |
| 4,341,299 | 7/1982 | Walker et al. | 198/434 |
| 4,778,323 | 10/1988 | Salts | 414/927 X |

FOREIGN PATENT DOCUMENTS

| | | | |
|---|---|---|---|
| 3627498 | 2/1988 | Fed. Rep. of Germany | 198/374 |
| 2450220 | 10/1980 | France | 414/795.3 |
| 7902741 | 8/1980 | Netherlands | 198/374 |
| 236320 | 1/1969 | U.S.S.R. | 198/414 |
| 0958449 | 5/1964 | United Kingdom | 414/795.3 |
| 1439434 | 6/1976 | United Kingdom | 414/795.3 |

*Primary Examiner*—Robert J. Spar
*Assistant Examiner*—William M. Hienz
*Attorney, Agent, or Firm*—Nies, Kurz, Bergert & Tamburro

[57] ABSTRACT

Stacking equipment for stacking products such as boxes or cartons in lay-flat form onto pallets, comprising a receiving conveyor (1) means (6, 7, 8) thereon for collecting a batch of products together in predetermined disposition, and a push plate (11) for transferring an assembled batch of products onto a main support bed (15). The bed (15) raises the batch of products onto retractable temporary support fingers (17) and then returns to receive the next succeeding batch. The batches are stacked successively and finally supported on a pallet which is elevated on bed (15) to support the finished stack which is then discharged from the bed. Also provided are a pallet dispenser (30) adjacent the support bed (15) and a tiesheet dispenser (20) to place an individual tie sheet on the top of each successive batch prior to stacking.

12 Claims, 2 Drawing Sheets

STACKING EQUIPMENT

Figure 1:
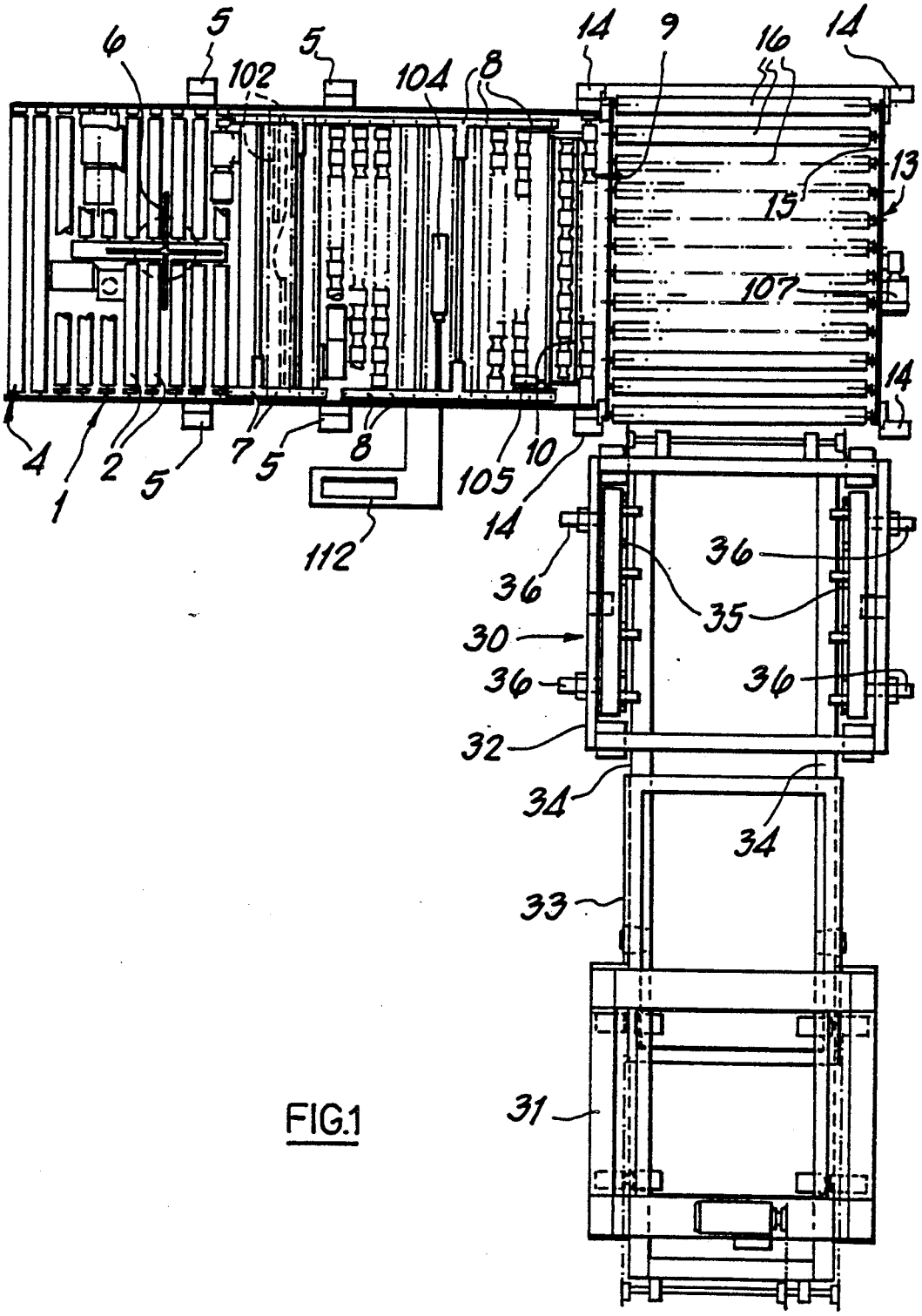

The invention relates to stacking equipment particularly, though not exclusively, for stacking products formed from corrugated board or other paper or board products (especially boxes or cartons in lay-flat form) on pallets.

Corrugated board is converted into cartons or boxes in lay-flat forms with automatic machinery and stacks of such lay-flat products are discharged from an outlet conveyor. The discharged stacks can then be accumulated as larger stacks on pallets for convenience of transport and storage. The discharged stacks are commonly transferred to the pallets by hand but this can be arduous and inefficient.

An object of the present invention is to provide stacking equipment whereby transfer of products to a stacking location can be effected automatically in a convenient and efficient manner.

According to the present invention there is provided stacking equipment comprising receiving means for receiving products to be stacked, collecting means for collecting said products together in predetermined disposition in successive batches, a main support means for supporting such batches at a stacking location, and transfer means for transferring said batches from said collecting means to said main support means and for introducing each successive batch beneath a preceding transferred batch whereby a stack of said batches is formed on said main support means.

With this arrangement as a consequence of the collecting means which permits attainment of a predetermined product disposition, and as a consequence of the assembly of the resulting stack from below, it is possible to achieve a neat and stable stack in a particularly convenient and efficient manner.

The receiving means may comprise a conveyor, such as a roller conveyor, which may run continuously. Where the stacking equipment is used with product-producing automatic machinery, an input end of the receiving means may be arranged to receive products automatically from an output of the machinery.

The collecting means may comprise a guide structure in conjunction with an abutment structure whereby the products are directed to the abutment structure to collect thereat in predetermined disposition. The guide structure may comprise a turntable for setting the angular disposition and/or one or more deflectors for setting the lateral disposition. Where the receiving means comprises a conveyor, the products may be advanced past the guide structure to the abutment structure by the action of the conveyor.

The transfer means may comprise an auxiliary support means above the main support means in conjunction with mechanisms which act automatically to transfer each batch from the collecting means to the main support means and from there to the auxiliary support means beneath any batch already on the latter support means, the final assembly of stacked batches then being deposited from the auxiliary support means onto the main support means. The main support means and the auxiliary support means may be vertically movable one relative to the other for transfer of batches therebetween. The auxiliary support means may comprise retractable fingers which can be readily inserted beneath and retracted from batches on the main support means. Conveniently the main support means may comprise a roller bed and the rollers may be arranged such that the abovementioned fingers fit therebetween.

An adjustment device, for example in the form of structures movable towards and away from each other, may be provided for adjusting the vertical alignment of the sides of the stack e.g. when the stack is on the abovementioned auxiliary support means.

The final assembly of stacked batches may be deposited on a pallet on the main support means and an automatic feed device may be provided for feeding the pallet onto the main support means prior to deposit of the stacked batches thereon.

The invention may find particular application in the stacking of corrugated board products. However the invention is not intended to be restricted to this context and the stacking equipment may be used for any suitable purpose.

Figure 2:
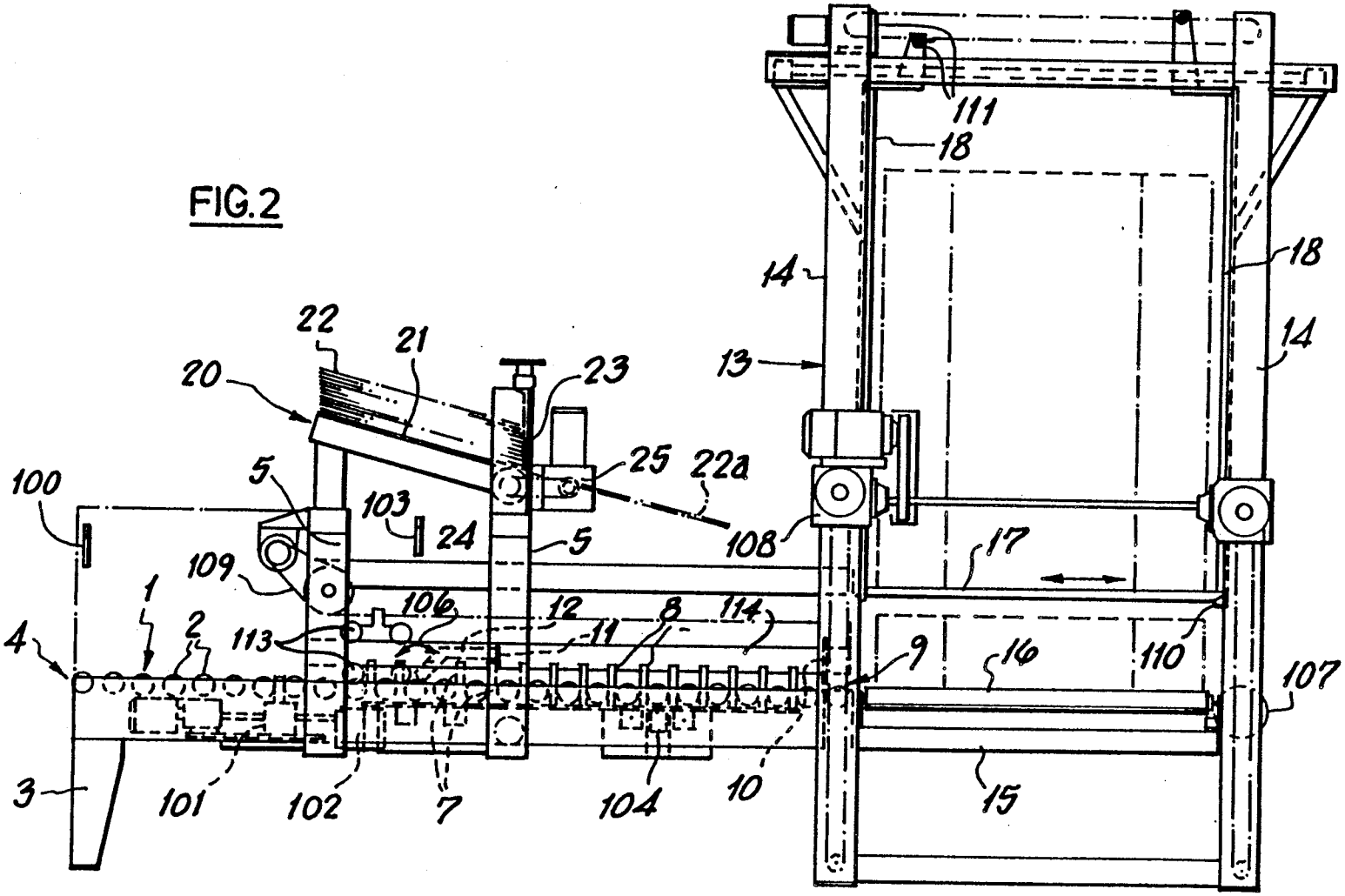

The invention will now be described further by way of example only and with reference to the accompanying drawing in which:

FIG. 1 is a diagrammatic plan view (with parts omitted for clarity) of one form of stacking equipment according to the invention; and FIG. 2 is a diagrammatic side view (with parts omitted for clarity) of the equipment of FIG. 1.

The equipment shown in the drawings is for use in the automatic assembly of stacks of flat corrugated board products on pallets.

The equipment includes a conveyor 1 comprising a horizontal bed of rollers 2 which can be continuously driven by an electric motor drive mechanism. The bed stands on adjustable legs 3 and has an inlet end 4 which can be arranged to receive products directly from an outlet end of product-producing machinery. The products delivered onto the conveyor 1 m ay be in the form of several superimposed corrugated board boxes or cartons in lay-flat form and the boxes or cartons may be loosely superimposed or may be tied together. A detector 100 is provided at the inlet end 4 of the conveyor 1 for detecting delivery of products onto the conveyor. The detector may be of the optical kind i.e. a light sensor receiving light from a source, such light being interrupted by the intrusion of delivery products.

The conveyor 1 is bounded at its sides by upstanding frames 5 and, near to the inlet end 4, there is a turntable 6 set into the roller bed. The turntable 6 is normally retracted beneath the roller bed but can be moved upwardly and can be rotated about a vertical axis with an automatic drive mechanism 101. In this way the products can be rotated through a predetermined angle as they pass along the conveyor 1.

Beyond the turntable 6 there are two sets of vertical push rods 7 respectively on opposite sides of the conveyor 1 and each set can be moved, between the conveyor rollers 2, across the conveyor 1 towards the other set, with an automatic drive mechanism 102. In this way the products can be shifted to either side of the conveyor 1. Adjacent each set of push rods 7 there is a detector 103 (e.g. an optical detector) for detecting the presence of products thereat.

Beyond the push rods 7 there are two further sets of push rods 8 respectively on opposite sides of the conveyor 1 and these sets can be moved towards each other, with an automatic pneumatic drive mechanism 104, between the conveyor rollers 2, to centralise products therebetween.

Slightly beyond the push rods 8, at an outlet end 9 of the conveyor 1, there is a stop plate 10 which can be moved, by an automatic drive mechanism 105, between a retracted position in which it is below the roller bed, and an extended position at which it is above the roller bed and acts as an abutment for products on the conveyor 1.

In the central region of the conveyor 1 there is a push plate arrangement 11 mounted on pivotal arms 12 so that it can be moved, as illustrated by arrow 106, by an automatic drive mechanism, between an operational position in which it extends across the conveyor 1 slightly above the roller bed, and a retracted position at which it is above and well clear of the roller bed. In the operational position the push plate 11 can be moved along the conveyor 1 towards the stop plate 10 by a carriage 113 chain driven along tracks 114 through a drive connection 109.

The outlet end 9 of the conveyor 1 is arranged to discharge to one side of a vertical frame structure 13. The frame structure 13 has upright columns 14 and mounted therebetween near the bottom is a platform 15 having a bed of rollers 16 which can be rotated with a drive motor 107. The axes of the rollers 16 are horizontal and perpendicular to the axes of the convey rollers 2. The platform 15 can be moved, with a drive mechanism 108, between a lower position (as illustrated) level with the conveyor 1 and a higher position.

At this higher position there is a series of horizontal forks 17 extending parallel to each other along axes which are parallel to and vertically above the spaces between the rollers 16 of the platform 15. The forks 17 are movable, with an automatic drive mechanism similar to drive connection 109, between an extended position at which they extend across the frame structure 13 to rest on supports 110, and a retracted position at which they are located over the conveyor 1 clear of the frame structure 13.

Between the forks 17 at opposite sides of the frame structure 13 there are two sets of vertical fingers 18 and these can be moved towards and away from each other with an automatic drive mechanism 111 which, as can be seen from FIG. 2, interconnects the two sets of fingers 18 so that they are constrained to move in unison.

The various drive mechanisms and detectors so far described, and various limit switches (not yet described) associated with parts of the equipment, are all connected to a computer control unit 112 with which the desired operation of the equipment can be selected and automatically controlled. The control units preferably has a VDU which produces a graphics display to assist the operator in selecting the desired orientation and mod of assembly of products on the conveyor.

Mounted above conveyor 1 on the upper end of vertical frame members 5 is a mechanism 20 for dispensing tie sheets. These are sheets of paper or cardboard of which one is placed on the top of each successive batch of products prior to delivery onto the rollers 16. Thus, tie sheets disposed between successive batches of products will assist in maintaining stability of the finished stack. This is particularly useful when the products consist of loosely tied bundles of lay-flat articles where each bundle is not necessarily of uniform height throughout its length and width.

The dispenser 20 comprises a supporting platform 21 on which a bundle of tie sheets 22 may be stored, and a vertically adjustable gate 23 forming a front wall against which the tie sheets lie. A friction roller 24 mounted beneath the leading edge of the lowermost sheet 22, and driven by motor 25, may serve to dispense a tie sheet as indicated at **22*a* onto the top of an accumulated batch of products on the conveyor 1**.

As can be seen in FIG. 1, a pallet dispenser generally indicated at 30 is preferably located adjacent one end of the bed of rollers 16 for the purpose of transferring a pallet onto the rollers 16 to be placed beneath a finished stack prior to the introduction of the next successive batch of products. The dispenser 30 comprises a first station 31 on which pallets may be stored in a stack, a second station 32 in which a stack of pallets may be supported, and a transfer platform 33 adapted to run along rails 34 to transfer stacks of pallets successively between stations 31 and 32.

Station 32 is equipped with retractable vertical side supports 35 which, by means of pneumatic cylinders 36, are movable towards one another to grip a stack of pallets. The vertical supports 35 extend downwardly to a position above the level of the height of a single pallet so that when a stack of pallets is supported by supports 35 the lowermost unsupported pallet may be advanced by platform 33 into an operative position on the bed of rollers 16. By successively manipulating vertical supports 35 and platform 33, pallets may be supplied beneath successive finished stacks of products. Supports 35 are also movable vertically to lower a stack of pallets on each occasion when the lowermost pallet is delivered onto rollers 16.

Typical operation of the equipment is as follows.

First the operator sets the control unit in accordance with a desired orientation and assembly of products in the final stack. That is, products (or small stacks of products) may be delivered to the conveyor 1 with a fixed common orientation and one behind another, but the stacking requirement may be that the products should be arranged e.g. side by side facing in opposite directions, especially where the products are of non-uniform (tapered) thickness. Accordingly, it may be necessary to set the control unit to cause the equipment to turn and move sideways the products (in the manner described hereinafter).

The rollers 2 of the conveyor 1 are set in continuous motion and products are fed (manually or automatically) onto the inlet end 4 of the conveyor 1 along the centre line of the conveyor.

Using information derived from the roller speed and the time of actuation of the entry detector 100 by products delivered to the conveyor 1, the turntable 6 is activated to move up and engage a product when its centre is aligned with the turntable centre. The product is rotated through a desired angle and then the turntable 6 is retracted to deposit the product back on the conveyor 1.

As the rotated product moves between the sets of push rods 7 one set is activated to push the product to the opposite side until the product reaches and activates a detector at such side. The product is advanced to the end of the conveyor 1 where it is retained by engagement with the stop plate 10.

The next product is rotated by the turntable 6 in the opposite direction and pushed to the opposite side whereby the two products are then arranged side by side facing in opposite directions against the stop plate 10. Alternatively, one or more products may be centralised by simultaneous operation of both sets of push rods 7. This sequence may be repeated to form an accumulation of products as a batch on the conveyor 1. The push rods 8 then move toward each other in accordance with a timed sequence to centralize the batch on the conveyor 1.

Once a batch is completed a tie sheet is placed on its top surface as described above and then the stop plate 10 is retracted, the push plate 11 is lowered into the operational position behind the batch and is advanced to push the batch of products off the conveyor 1 onto the platform 15, such action terminating when a limit switch is engaged by the push plate 11. The push plate 11 is pivotted upwardly clear of the conveyor 1 and returned to its starting position, and the stop plate 10 is raised to lie above the roller bed of the conveyor 1.

With the forks 17 in their extended positions resting on supports 110, the platform 15 is moved upwardly until the forks 17 are engaged by the supported batch. A limit switch is thereby actuated, the forks 17 are retracted, the platform 15 is moved slightly higher to its uppermost position, and the forks 17 are again extended to pass between the rollers 16 and beneath the supported products to rest on supports 110. Vertical fingers 18 are then moved toward each other in unison until they engage the two opposite sides of the supported products (as detected by a limit switch) so as to centralize the products and thereby establish a neat, stable, vertical-sided stack.

The platform 15 descends to its lowermost position leaving the products supported on the forks 17.

The above procedure is repeated with successive batches of products. Each successive batch is transferred onto the forks 17 beneath the preceding assembly (or stack of assemblies). That is, when the supported products on the platform 15 are moved up into engagement with the forks 17, the forks 17 retract so as to drop onto the supported products, all those products which were already on the forks and the resulting increased stack is then transferred back to the forks 17.

When a stack of desired height has been assembled on the forks 17, the conveyor 1 is stopped, a pallet is positioned on the platform 15 (from the pallet dispenser 30), the platform 15 is raised, the forks 17 are retracted to deposit the stack onto the pallet, the platform 15 descends to its lowermost position, and the rollers 16 of the platform 15 are driven to discharge the palletised stack to a delivery conveyor or the like positioned opposite pallet dispenser 30.

With the embodiment described palletised stacks can be formed in a particularly convenient and efficient manner.

It is of course to be understood that the invention is not intended to be restricted to the details of the above embodiment which are described by way of example only. Thus, for example, although reference is made to rotation and sideways movement of the products on the conveyor depending on requirements and the nature of the product one or both of these operations may not be required.

I claim:

1. Stacking equipment comprising: a driven conveyor for receiving successive products to be assembled in pre-determined disposition into a batch thereon; a stop member to which the products are conveyed on the conveyor; at least one deflector horizontally movable transversely of the conveying direction to determine the lateral positions of individual products thereon as the batch is assembled; at least two further deflectors simultaneously horizontally movable toward and away from each other transversely of the conveying direction to centralize the transverse disposition of the assembled batch; a main support means for supporting each batch at a stacking location; a retractable push plate movable into position behind an assembled batch on said driven conveyor for transferring same longitudinally onto said main support means; retractable auxiliary support means above said main support means to which each successive batch may be transferred by raising the main support means until said successive batch is positioned immediately beneath or in contact with said auxiliary support means, temporarily retracting the auxiliary support means, further raising the main support means to its highest position, extending the auxiliary support means so as to interfinger with the main support means, and then lowering the main support means, whereby a stack of said batches is formed on the auxiliary support means; and vertically disposed structures above the auxiliary support means simultaneously movable toward and away from each other in a direction parallel to the direction of movement of said batches onto said main support means to centralize the longitudinal disposition of the assembled batches over the main support means and to determine the vertical alignment of the longitudinal sides of the stack on the auxiliary support means, so that the longitudinal centering occurs over the main support means and the transverse centering occurs over the conveyor.

2. Stacking equipment according to claim 1, including a turntable on said driven conveyor for setting the orientation of the products conveyed thereon.

3. Stacking equipment according to claim 1, wherein the two further deflectors are provided for setting the lateral positions of said products, the two further deflectors being movable inwardly from opposite sides of the driven conveyor.

4. Stacking equipment according to claim 1, wherein the main support means is movable vertically relative to the auxiliary support means for transfer of batches of products therebetween.

5. Stacking equipment according to claim 1, wherein the auxiliary support means comprises a plurality of parallel retractable fingers adapted for insertion beneath and retraction from beneath one or more batches supported on the main support means.

6. Stacking equipment according to claim 5, wherein the main support means comprises a bed of parallel rollers, and the retractable fingers are aligned vertically with the spaces between the rollers.

7. Stacking equipment according to claim 1, including a pallet dispenser disposed adjacent the main support means and adapted to provide a store for a stack of pallets, and including means for delivering pallets successively from said store to a position centrally disposed on said main support means to receive a final stack of products.

8. Stacking equipment according to claim 7, wherein said pallet dispenser includes vertical members for supporting respective opposite sides of a stack of pallets, and means to transfer the lowermost pallet from beneath a stack thereof onto said main support means while the stack of pallets thereabove is supported by said vertical members.

9. Stacking equipment according to claim 1, including a tie-sheet dispenser comprising means for supporting a stack of tie-sheets and means for dispensing a sheet from the stack of tie-sheets onto the top surface of an assembled batch of products prior to its transfer onto said main support means whereby successive vertically adjacent batches of products within the stack thereon are interposed by a tie-sheet.

10. Stacking equipment according to claim 9, wherein the tie-sheet dispenser includes an adjustable control gate to ensure that said sheets are fed one at a time from the dispenser.

11. Stacking equipment according to claim 1, including a plurality of detectors to determine the instantaneous position of a product or batch thereof within the equipment, and a computer control unit connected to receive signals from said detectors and to actuate, in accordance with a predetermined time sequence, various drive mechanisms such that the desired operation of the equipment can be selected and automatically controlled.

12. Stacking equipment according to claim 1, wherein the retractable push plate is movable to transfer a batch onto the main support means simultaneously with operation of the driven conveyor.

* * * * *